United States Patent [19]

Mackey

[11] 4,258,692

[45] Mar. 31, 1981

[54] COMBINATION WOOD AND COAL STOVE

[75] Inventor: Ralph E. Mackey, Everett, Wash.

[73] Assignee: Washington Stove Works, Everett, Wash.

[21] Appl. No.: 7,912

[22] Filed: Jan. 30, 1979

[51] Int. Cl.[3] ..... F24C 1/00; F23H 7/08; F23H 7/10

[52] U.S. Cl. ..... 126/60; 126/176 R; 126/152 B; 126/174

[58] Field of Search ..... 126/58, 77, 83, 120, 126/121, 152, 161, 174, 181, 182, 176, 176 A, 60

[56] References Cited

U.S. PATENT DOCUMENTS

| | | | |
|---|---|---|---|
| 249,129 | 11/1881 | Westland | 126/174 |
| 1,256,798 | 2/1918 | Herman | 126/161 |
| 2,352,567 | 6/1944 | Raulston | 126/77 |
| 2,746,406 | 5/1956 | Karjala | 126/83 |
| 2,855,919 | 10/1958 | Prim | 126/83 |
| 3,685,506 | 8/1972 | Mouat | 126/121 |
| 4,074,679 | 2/1978 | Jensen | 126/121 |

FOREIGN PATENT DOCUMENTS

| | | | |
|---|---|---|---|
| 34249 | 6/1932 | Netherlands | 126/58 |

*Primary Examiner*—Carroll B. Dority, Jr.
*Assistant Examiner*—Wesley S. Ratliff, Jr.
*Attorney, Agent, or Firm*—Clarence A. O'Brien; Harvey B. Jacobson

[57] ABSTRACT

A solid fuel stove is disclosed having a hinged door adapted for loading of aggregate solid fuel in the form of lumps or chunks, such as coal, and a second hinged door located at the side or end of the stove, adapted for loading of elongated sections of long solid fuel, such as sections of wood. The stove further includes a third hinged door for cleaning out ashes, and a scoop-shaped baffle for restricting the flow of flue gases and diversion of unburned gases back into the combustion zone. Cast iron liners confine the burning area and protect the stove walls, and oval collar sections connect the upper back section of the stove with a conventional smoke pipe for exhausting the products of combustion.

12 Claims, 8 Drawing Figures

4
26
24
22
20
10
12
28
38
14
100
98
94
96
86
72
69
68
88
66
46
78
18
116
107
4

26
100
24
22
20
56
94
16
14
54
73
86
88
68
56
78
66
116
107
104
116

40
14
73'
86
66
116
62
12
90
52
46
38
66
32
88
68
16
86
62
60
54
78
58

36
38
38
40
36

56

102
54

COMBINATION WOOD AND COAL STOVE

BACKGROUND OF THE INVENTION

1. Field of the Invention

The invention relates to a solid fuel stove, especially for indoor use. More particularly, the stove is especially adapted for loading of either coal or wood sections, or both, through openings at the front and side or end of the stove, respectively, each of which is provided with an appropriate hinged door.

2. Description of the Prior Art

Metal stoves for burning of coal or wood have long been known in the art. For instance, the following patents illustrate stoves embodying various features of construction, including a hinged stove door with mica windows, fireboxes with cast iron liners, rotatable grates, sectional structures, draft controls and baffles and are illustrative of the state of the prior art:

| | |
|---|---|
| 30,074 - Sept. 18, 1860 | 400,481 - April 2, 1889 |
| 116,768 - July 4, 1871 | 501,885 - July 18, 1993 |
| 129,020 - July 16, 1872 | 629,544 - July 25, 1899 |
| 129,711 - July 23, 1872 | 1,645,244 - Oct. 11, 1927 |
| 201,255 - March 12, 1878 | 1,827,046 - Oct. 13, 1931 |
| 216,708 - June 17, 1879 | 4,027,649 - June 7, 1977 |
| 283,790 - Aug. 28, 1883 | D-237,798 - Nov. 25, 1975 |

However, these prior art patents reveal certain shortcomings, inasmuch as as none of these patents discloses the combination of a front door and associated draft control which is used primarily when burning coal and an end door for facilitating insertion of relatively long sections of wood, combined with an ash pit door, draft control and grate rotating components. Moreover, a disadvantage commonly found in existing stoves is collection of ashes on the grate, a circumstance which necessitates frequent cleaning during operation and causing considerable inconvenience to the users of the stove. Furthermore, build up of ash residue beneath the grate can lead to reduced air circulation, require frequent emptying of ashes and create further inconvenience to the stove operators. Conventional solid fuel stove doors are made from solid sheet cast metal, precluding visual observation of the progress of combustion within the stove. Alternatively, the stoves have portholes or vents, which leads to undesirable heat loss through drawings of air into the combustion chamber, or expulsion of combustion products into the ambient surroundings.

SUMMARY OF THE INVENTION

The disadvantages of the prior art constructions of wood or coal burning stoves have been overcome with the present invention through the combination of a substantially rectangular metal stove of somewhat greater width than depth, the stove front having a hinged door with an opening covered by mica sheets for visual observation of the combustion zone, with the front door permitting introduction of lumps or chunks of aggregate solid fuel, such as coal, and with a side door allowing introduction of sections of elongated solid fuel, such as logs of wood.

A shaker grate, preferably made of cast iron and rotatable so as to give the user a choice of grate position adapted for either burning wood, or, by rotating the grates from the outside, for burning of coal. With use of the shaker grate, it is furthermore possible to reduce ash build up by imparting reciprocating to it from the outside, thereby causing ashes generated during use of the stove to be deposited downwardly from the combustion zone into an ash drawer for accumulation and subsequent removal. The ash drawer is accessible for ash removal through a hinged ash door located beneath the side door. The ash door has mounted in its face an adjustable type cover or bell draft for control of incoming combustion air, and also allows access beneath the grates to facilitate ash removal.

Inside the stove a scoop-shaped baffle is mounted immediately below the flue passage opening to restrict the flow of flue gases and to indirectly divert unburned gases back toward the direction of burning fuel. Cast iron replaceable liners are provided around the combustion zone to confine the combustion zone over the grates and protect the side and end walls of the stove.

Accordingly, an important object of the invention is to provide a solid fuel stove adapted for burning either aggregate solid fuel, such as coal and the like, or elongated solid fuel sections, such as wood logs.

Another object is to incorporate into the stove a grate rotatable externally, thereby to give the stove user the capability of adapting the grate configuration to the type of solid fuel chosen.

Still another object is to permit direct visual observation of burning contents of the stove through a transparent refractory window, such as a sheet of transparent mineral, for example, mica.

Yet another object is to provide for convenient ash removal from the stove, and to maximize the period of stove use between ash cleaning operations.

A further object is to improve fuel efficiency by providing internal baffling to direct gaseous combustion products back toward and into the combustion zone.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 6:
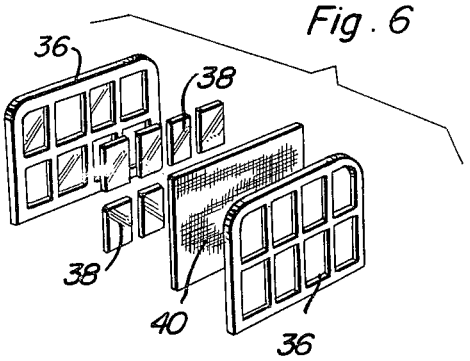
FIG. 6 is a group perspective view of the transparent window and screen arrangement for the front door of the stove shown in FIG. 1.

The stove of the present invention, designated in the drawings generally by the numeral 10 is made of individual sections having overlapping ridges and grooves which are filled with an insulating material, preferably of a refractory material, such as asbestos cement. The individual sections are preferably made from a heat-resistant metal, such as cast iron, although sections of other materials, such as sheet steel, refractory blocks, coated or galvanized iron, or other well known materials, either cast or fashioned by other means, such as by stamping, molding, casting, bolting, clamping, or the like, can also be used for some or all components of the invention. These sections making up stove 10 include front section 12, side section 14, back section 16, base section 18, firebox roof 20, and crown 22, which is provided with a decorative ornament 24 including ring 26, which can be used for lifting if desired. Hinged front door 28 is attached to front section 12 by hinges 30, front door 28 turning about rivets 31 placed in hinges 30, cast into or welded to front door 28, and in receptacles 32, cast into or welded to front section 12. Front door 28 is provided with front door opening 34, which comprises a pair of cast iron frames 36, into the inner one of which are placed mica sheets 38, held in place by screen 40 and outer cast iron frame 36, as best seen in FIG. 6. Front door 28 is provided with front door handle 40 for opening front door 34 when kindling a fire in stove 10 or introducing fuel, such as coal, through front opening 42. Below front door 28 is front convex panel 44, on which is centrally placed bell draft 46 for adjustably admitting air into the stove. Panel 44 is provided with an air inlet opening 48, as best seen in the illustration of a similar bell draft 46 located on ash door 47, FIG. 8. The threaded wing nut 50 fits into a threaded hole in panel 44 drawing bell 52 in closer proximity to opening 48 and thereby restricting the flow of air.

Figure 8:
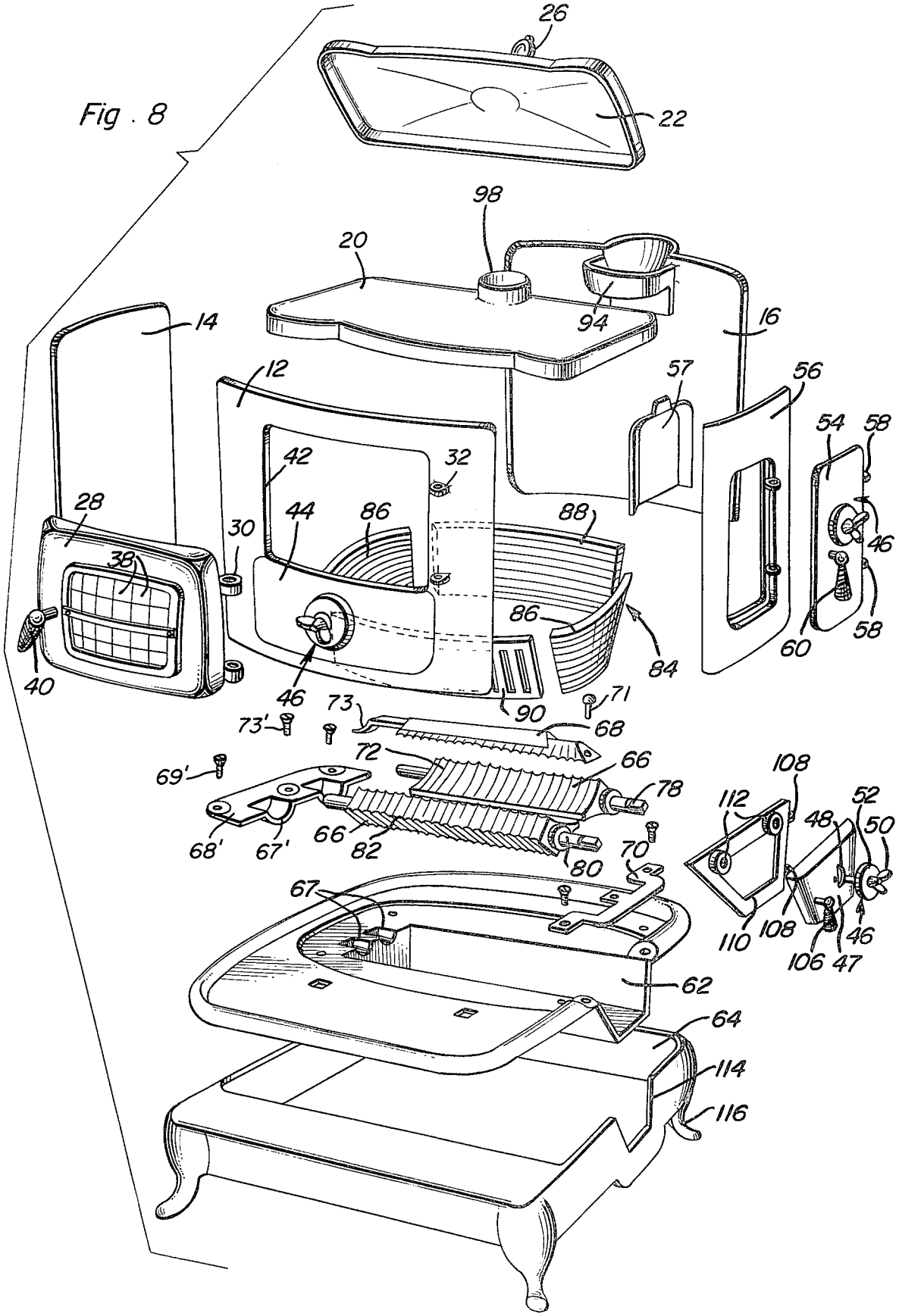
FIG. 8 is an exploded perspective view of certain internal components of the stove of FIG. 1, showing the relationship and association of the base, ash drawer, rotating grates, grate ridge, firebox liners, front opening, front door, side and rear wall panels, flue baffle, firebox roof, and other associated components.

Side door 54, also provided with a bell draft 46, is particularly useful for introducing sections of wood, such as logs of appropriate size and length, into the combustion zone of stove 10. Opening of hinged side door 54, mounted on side panel 56 by hinges 58, is facilitated by handle 60, which is similar in construction and purpose to handle 40 on front door 28. Front panel 12, rear panel 16, and side panels 14 and 56 are mounted upon base 18 which also supports the grate structure and firebox liner. The grate structure and firebox liner are mounted upon ash drawer 62, which rests upon base frame 64 and mounts rotating grates 66 in recesses 67' of panel 68' placed at the end opposite side door 54, and below support bracket 70, at the end nearest to side door 54. Panel 68' is secured to ash drawer 62 by bolts 69', recesses 67' fitting into recesses 67 of ash drawer 62. Grates 66 extend from side to side in substantially parallel configuraion and in the longest dimension of stove 10, thereby facilitating burning of segments of wood, such as logs of appropriate diameter and thickness. Grate ridge 68 is placed between grates 66, secured to bracket 70 by bolt 71 and secured to panel 68' by means of bolt 73' placed through flange 73. When grates 66 are to be used for burning of wood, they will preferably be used in the configuration of FIG. 3, with support of generally parallel burning logs being afforded by the upper ridge of grates 66, as well as by the upper edges and surfaces of grate ridge 68. In such a configuration, the gap between lateral edge 69 of grate ridge 68 and scalloped surfaces 72 of grates 66 is maximum for permitting maximum upward draft air and facilitating downward ejection of ash particles into ash drawer 62. Rotation in reciprocating motion of grates 66 can be used for dislodging and dropping of ash particles from the combustion zone, such rotation being conveniently effected with use of detachable crank 74, having socket end 76 with a recess (not shown) compatible with projecting square end 78 of rod 80 centrally and longitudinally disposed along grate 66. Scalloped surfaces 72 of grate 66 can be oriented with respect to fixed grate ridge 68 by either clockwise or counterclockwise rotation through 45 degrees from the position shown in FIG. 3. In such a configuration, edge 82 of grate 66 will be placed in close proximity to grate ridge 68, thereby leavinga minimum gap therebetween for retention of relatively small particles of combustible material, such as lumps of coal. Such rotation is also facilitated by use of crank 74. The entire combustion area is surrounded by firebox liner 84, which comprises preferably cast iron replaceable liners which serve to confine the burning area over grates 66, and further serve to protect side, front and end panels 14, 56, 12 and 16 from the deleterious effects of direct exposure to the fire in the combustion zone. Firebox liner 84, best seen in FIG. 8, is composed of horizontal reinforcement ribbing on side firebos liner sections 86, horizontal reinforcement ribbing on back firebox liner 88, and vertical ribbing for front firebox liner 90. A smoke curtain 57 can also be welded or otherwise attached to side panel 56 to prohibit excessive smoke from leaving stove 10.

Figure 1:
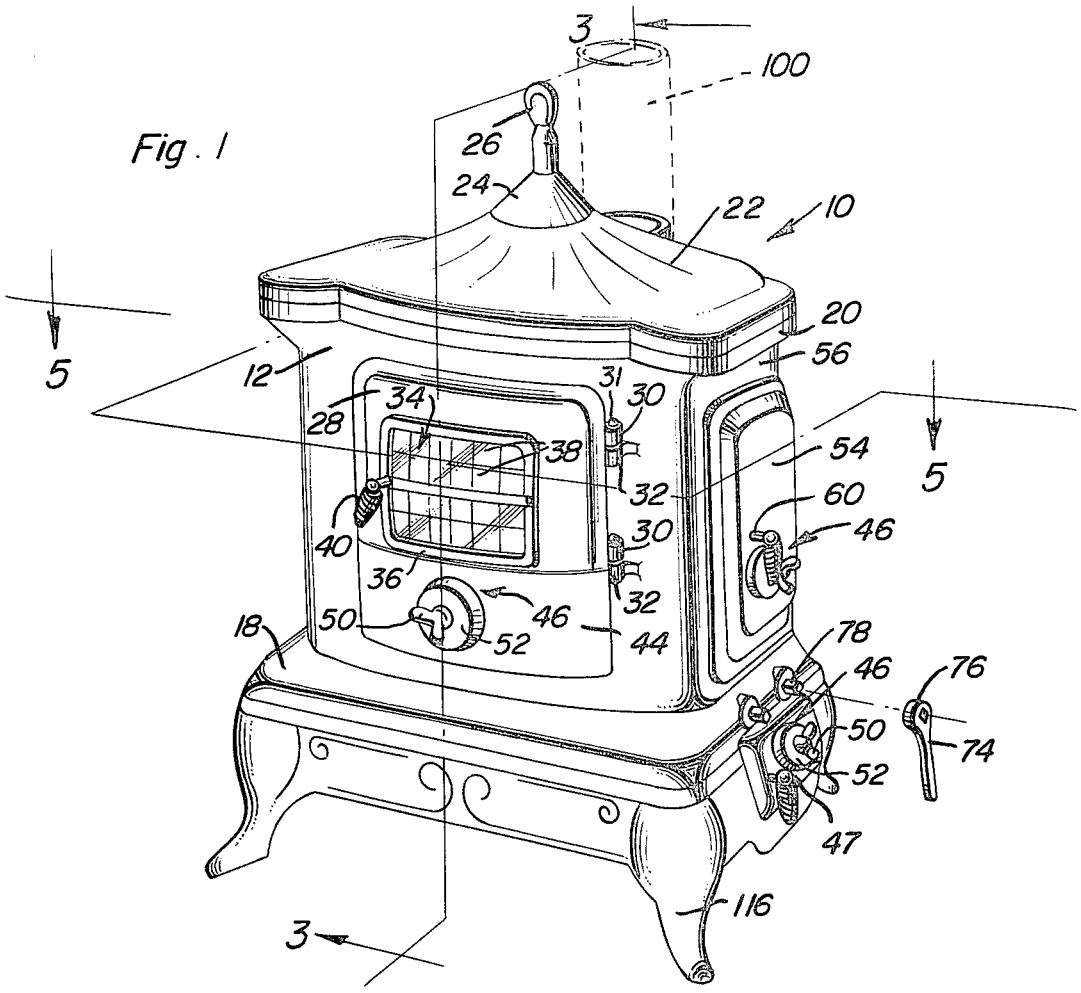
FIG. 1 is a perspective view of a preferred embodiment of the present invention, showing the initial section of exhaust gas flue in phantom.
Figure 2:
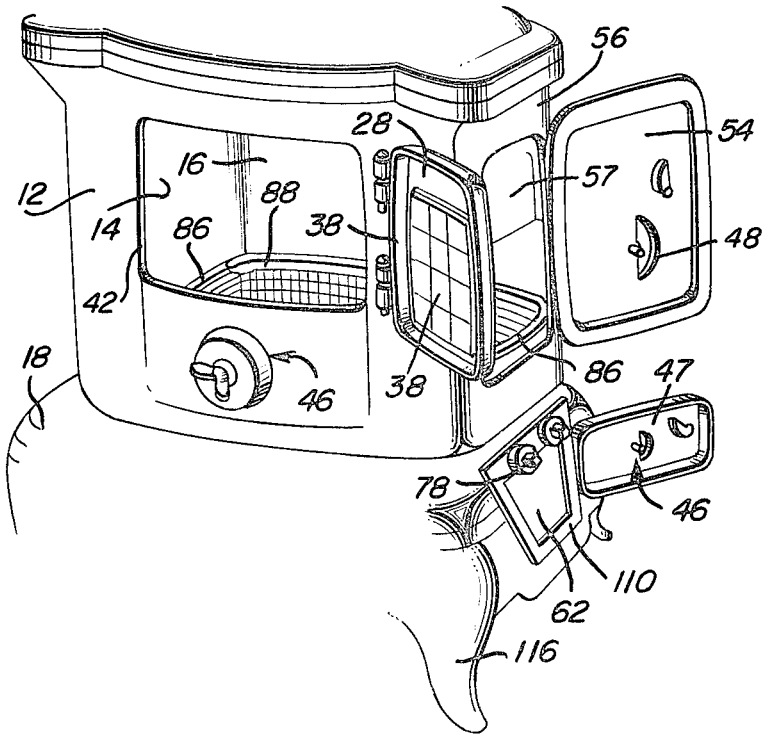
FIG. 2 is a fragmentary perspective view of the stove, showing all hinged doors in the opened position, thereby permitting a partial view of inside components.
Figure 3:
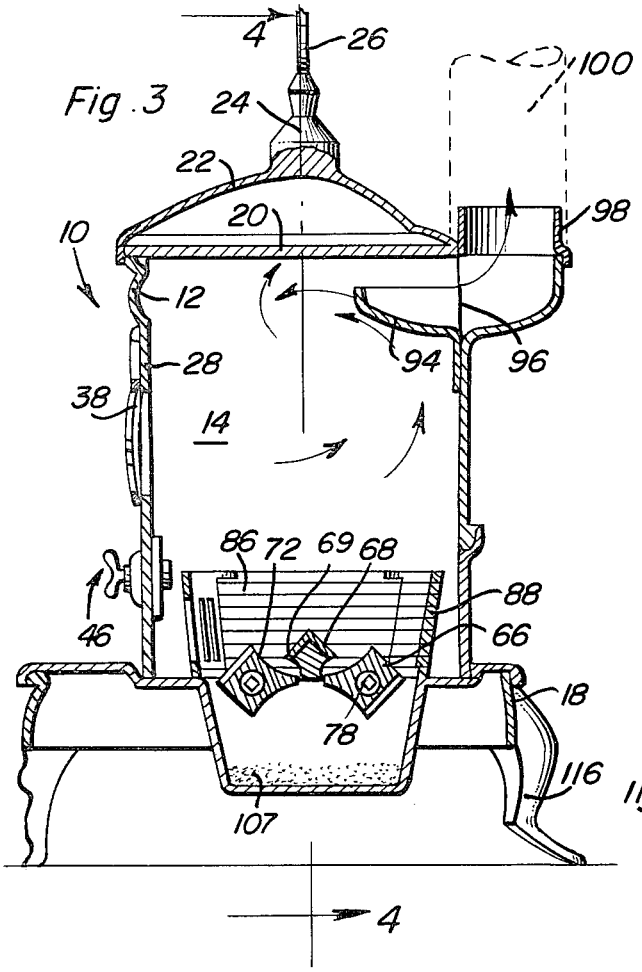
FIG. 3 is a transverse sectional view of the stove of the present invention, taken substantially upon a plane passing along section line 3—3 on FIG. 1, and showing patterns of internal gas circulation of gaseous products of combustion inside the stove by means of arrows, and further showing details of the internal components of the stove, including the rotating grates, grate ridge, ash drawer, firebox liner, flue baffle, and other components.
Figure 4:
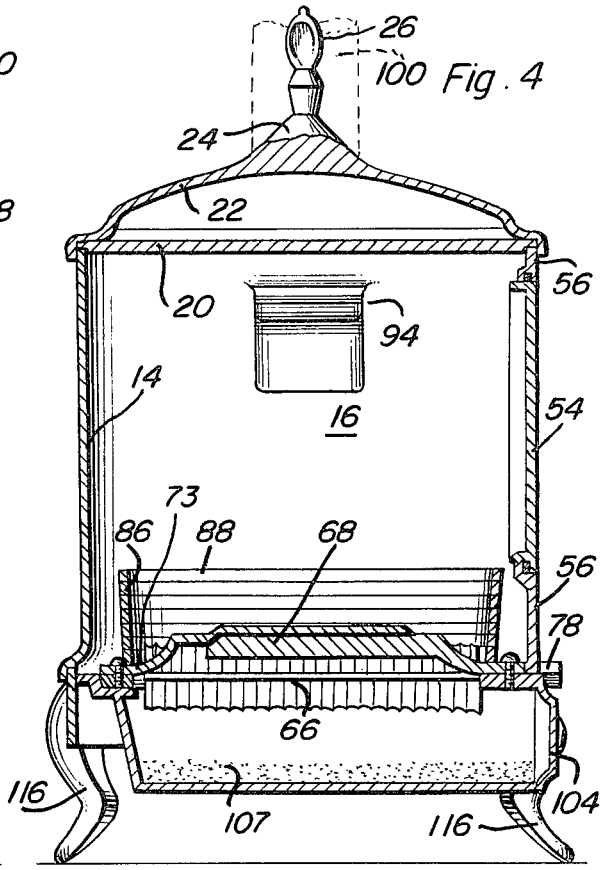
FIG. 4 is a longitudinal sectional view of the stove, taken substantially upon a plane passing along section line 4—4 on FIG. 3, and showing further details of the internal components thereof.
Figure 5:
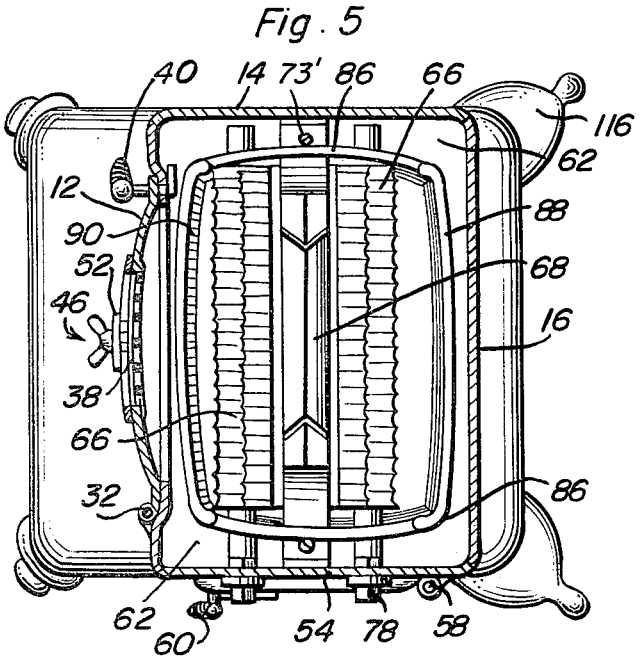
FIG. 5 is a top sectional view of the stove of FIG. 1, taken substantially upon a plane passing along section line 5—5 on FIG. 1, giving a top plan view of internal components.

The gaseous combustion products follow a circulation pattern inside stove 10 best seen in FIG. 3 from the directions of arrows representing general flow lines for hot combustion products. Scoop-shaped baffle 94 deflects gases rising upwardly from the region inside firebox liner 84 to divert any unburned gases forwardly and assist in drawing such gases back towards the burning fuel. This promoted more thorough and complete combustion, and leads to greater fuel efficiency. Moreover, baffle 94, mounted immediately below flue passage opening 96, restricts the flow of flue gases and further promotes full combustion thereof. Cast into the upper back section, and into the rear of roof 20 are matching one-half sections 98 of oval collar, which when both parts are matched and bolted form a connecting collar on which smoke pipe connection 100 is mounted. A standard smoke pipe is used to exhaust the products of combustion.

Figure 7:
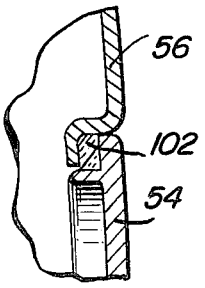
FIG. 7 is a fragmentary enlarged sectional view of a joint between panel sections of the stove of FIG. 1, showing the insulating means therebetween.

Individual sections of stove 10, such as side section 56 and side door 54 are fitted together with overlapping ridges and grooves which are cast into the individual parts. The interlocking sections are sealed with asbestos type or other high temperature cement, such as strip 102, as best seen in FIG. 7.

Ash door 47 is conveniently opened with the use of conventional handle 106 for removal of accumulated ashes 107 in ash drawer 62. Ash door 47 is mounted by hinges on hinge collars 108 on ash frame 110. Frame 110 is provided with bearing holes 112, through which rods 80 of grates 66 pass and are supported. A suitable indentation 114 in base frame 64 allows for fitting of ash drawer 62 as well as frame 110. Base frame 64 is also provided with appropriate legs 116 for support thereof.

Preferably, sections of stove 10 are made from cast metal, such as cast iron. Overlapping ridges and grooves cast into the individual parts provide for interlocking cast iron sections fitted together and sealed with asbestos type or other high temperature cement.

Although the present invention can be constructed in a wide variety of shaped and sized without departing from the essential nature of the invention, such varying constructions being contemplated within the scope of the invention, in a typical preferred embodiment, the stove has approximate dimensions of 30 ½ inches in height, 22 inches in depth, and 26 inches in width, giving a shipping weight of approximately 319 pounds and permitting logs having a length up to 21 inches to be burned. This stove is also adapted for use with coal, such as grades of coal particularly suitable for combustion and indoor stove, such as cannel coal, a bituminous coal containing considerable volatile matter which burns brightly.

It is of particular importance that in one embodiment of the invention the combination of rotating grate for adapting the combustion zone for supporting either coal or wood by adjustment of the grate, front door for loading and distributing coal along the longitudinal extent of grates, and side door for loading of long wood, be all present together in a single stove, as taught by the present invention. With this combination, the best conditions of combustion of either selected solid fuel is obtained without the necessity for internal adjustments or even the necessity for cooling of the stove for conversion from coal to wood or wood to coal. This flexibility renders apparent the advantage in a typical situation of use where the supply of either coal or wood might be limited, such as by storage capacity, and where conversion from one to the other is expectable during use. Accordingly, with the present invention, it is possible to reduce the storage supply of fuel, such as coal, inasmuch as a more readily available source of wood fuel can be easily substituted without requiring the stove and ambient indoor surroundings to cool prior to conversion.

Moreover, the combination of the particular rotating grate, ash drawer and mica window of the present invention are distinguishing features from prior art stove combinations, offering advantages of convenience in use, improved performance and greater fuel efficiency, and improved observation and control of the operation of the stove.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a solid fuel burning stove having enclosure means for confining the solid fuel undergoing combustion and exhaust means for removal of gaseous products of combustion, the combination of a first door on the enclosure means for opening to permit introduction and distribution of aggregate solid fuel in the form of granules, lumps and the like into the enclosure means , a second door on the enclosure means for opening to permit introduction of elongated sections of long solid fuel into the enclosure means, and rotatable grate means mounted inside the enclosure means for supporting said solid fuel undergoing combustion, said grate means being adapted for adjustment to support said aggregate solid fuel or said long solid fuel, said enclosure means defining a width and depth of said stove and including a door side panel defining said depth and on which said second door is mounted by hinge means, and a front panel defining said width and on which said first door is mounted by hinge means, said first door being provided with a bell draft for controlling entrance of air therethrough, and said second door being provided with a bell draft for controlling entrance of air therethrough.

2. The combination of claim 1 wherein said enclosure means comprises a support base, ash removal means resting on the support base and holding said grate means, a plurality of interlocking lateral panels resting on said support base, and cover means over said interlocking panels, said exhaust means being affixed to the cover means.

3. The combination of claim 2 wherein said lateral panels comprise a side panel, a back panel.

4. The combination of claim 3 wherein said enclosure means further includes replaceable heat resistant firebox liners for protecting said lateral panels, first door, and second door.

5. The combination of claim 3 wherein said stove has a substantially rectangular shape and said width is greater than said depth.

6. The combination of claim 4 wherein said firebox liners comprise a horizontally reinforcement ribbed rear firebox liner substantially parallel to the back panel, a pair of horizontally reinforcement ribbed side firebox liners disposed substantially parallel to said side panels and a vertically slotted front firebox liner, disposed substantially parallel to said front panel, said firebox liner enclosingly defining the combustion zone within said enclosure, and said ash removal means comprises an ash drawer for holding solid products of combustion.

7. The combination of claim 6 wherein the bottom portion of said combustion zone is defined by said grate means and a grate ridge extending longitudinally above said ash drawer from the base of said side firebox liners, the grate means comprising a pair of elongated rotatable grates substantially parallel to and in spaced relationship with said grate ridge, said rotatable grates having a plurality of surfaces and edges positionable with respect to said grate ridge by rotation of said grates with external cranks means so as to permit a maximum gap between one of said surfaces and said grate ridge for use with said long solid fuel, and to permit positioning of said grates by rotation with said handle means for a minimum gap between said grate edge and said grate ridge for use with said aggregate solid fuel, said rotatable grates being further adapted for reciprocating motion with said crank means for facilitating collection of the solid products of combustion from said combustion zone into the ash drawer.

8. The combination of claim 7 wherein said base section is provided with an ash door for access to said ash drawer, said ash door being hinged for attachment to said base section and said ash door further being provided with adjustable draft means for controlling entrance of air into said combustion zone within said enclosure means.

9. The combination of claim 8 wherein said rear panel is provided with a scoop-shaped baffle extending inwardly from said rear panel in obscuring relation between said exhaust means and said combustion zone, whereby unburned gaseous products of combustion are diverted back toward said combustion zone, and the flow of said gases to said exhaust means is restricted.

10. The combination of claim 9 wherein said first door is provided with an opening having heat transparet means for viewing said combustion zone therethrough.

11. The combination of claim 10 wherein said transparent means comprises mica sheets held in place by a heat resistant rigid frame and a heat resistant screen.

12. The combination of claim 11 wherein said exhaust means includes one-half sections of an oval collar for connecting said stove to exhaust pipe means for exhausting said gaseous products of combustion.

* * * * *